US011372436B2

(12) United States Patent
Ahmed

(10) Patent No.: US 11,372,436 B2
(45) Date of Patent: Jun. 28, 2022

(54) SIMULTANEOUS LOW QUIESCENT CURRENT AND HIGH PERFORMANCE LDO USING SINGLE INPUT STAGE AND MULTIPLE OUTPUT STAGES

(71) Applicant: QUALCOMM Incorporated, San Diego, CA (US)

(72) Inventor: Shamim Ahmed, Tempe, AZ (US)

(73) Assignee: QUALCOMM INCORPORATED, San Diego, CA (US)

( * ) Notice: Subject to any disclaimer, the term of this patent is extended or adjusted under 35 U.S.C. 154(b) by 73 days.

(21) Appl. No.: 16/600,664

(22) Filed: Oct. 14, 2019

(65) Prior Publication Data

US 2021/0109554 A1 Apr. 15, 2021

(51) Int. Cl.

| | |
|---|---|
| ***G05F 1/575*** | (2006.01) |
| ***G05F 1/563*** | (2006.01) |
| ***G05F 1/59*** | (2006.01) |
| ***G05F 1/46*** | (2006.01) |

(52) U.S. Cl.

CPC ..... *G05F 1/575* (2013.01); *G05F 1/462* (2013.01); *G05F 1/563* (2013.01); *G05F 1/59* (2013.01)

(58) Field of Classification Search

CPC . G05F 1/10; G05F 1/575; G05F 1/461; G05F 1/46; G05F 1/56; G05F 1/562; G05F 1/563; G05F 1/565; G05F 1/59; G05F 1/613; G05F 1/614

See application file for complete search history.

(56) References Cited

U.S. PATENT DOCUMENTS

| | | | |
|---|---|---|---|
| 5,631,598 | A | 5/1997 | Miranda et al. |
| 6,046,577 | A | 4/2000 | Rincon-Mora et al. |
| 6,147,550 | A | 11/2000 | Holloway |

(Continued)

FOREIGN PATENT DOCUMENTS

| | | | |
|---|---|---|---|
| CN | 1175018 | A | 3/1998 |
| CN | 100367142 | C | 2/2008 |

(Continued)

OTHER PUBLICATIONS

Chengpeng L., et al., "FVF LDO Regulator with Dual Dynamic-Load Composite Gain Stage", Analog Integrated Circuits and Signal Processing, Springer New York LLC, US, vol. 92, No. 1, Apr. 17, 2017 (Apr. 17, 2017), pp. 131-140, XP036245594, ISSN: 0925-1030, DOI: 10.1007 /S10470-017 -0972-9, [retrieved on Apr. 17, 2017], abstract; figure 3.

(Continued)

*Primary Examiner* — Gustavo A Rosario-Benitez

(74) *Attorney, Agent, or Firm* — Chui-kiu Teresa Wong

(57) ABSTRACT

A simultaneous low quiescent current and high performance low dropout (LDO) voltage regulator is disclosed. In some implementations, the LDO voltage regulator includes a first and a second pass transistors configured to receive an input voltage (Vin). The LDO voltage regulator further includes an error amplifying module having a first output, a second output, a first input, and a second input. The error amplifying module can further include a first output stage configured to drive the gate of the first pass transistor during a high performance (HP) mode, and a second output stage configured to drive the gate of the second pass transistor during the HP mode and during a low power (LP) mode.

5 Claims, 5 Drawing Sheets

(56) References Cited

U.S. PATENT DOCUMENTS 6,188,211 B1 2/2001 Rincon-Mora et al.
6,188,212 B1 2/2001 Larson et al.
6,359,427 B1 3/2002 Edwards et al.
6,522,111 B2 2/2003 Zadeh et al.
6,586,917 B1 7/2003 Smith
6,617,832 B1 9/2003 Kobayashi
6,791,390 B2 9/2004 Gay
6,856,124 B2 2/2005 Dearn et al.
7,106,032 B2 * 9/2006 Chen ..... G05F 1/569 323/269
7,109,690 B2 9/2006 Ke et al.
7,148,670 B2 12/2006 Inn et al.
7,215,103 B1 * 5/2007 Wong ..... G05F 1/573 323/279
7,312,598 B1 * 12/2007 Huang ..... G05F 1/575 323/280
7,492,137 B2 2/2009 Yamada
7,495,420 B2 2/2009 Vinn
7,504,814 B2 3/2009 Lee et al.
7,548,051 B1 6/2009 Tenbroek et al.
7,622,902 B1 11/2009 Kao et al.
7,710,090 B1 5/2010 Kimura
7,893,670 B2 2/2011 Pulijala et al.
8,072,196 B1 12/2011 Li
8,080,983 B2 12/2011 Lourens et al.
8,115,463 B2 2/2012 Wang
8,154,263 B1 4/2012 Shi et al.
8,248,150 B2 8/2012 Tadeparthy et al.
8,294,441 B2 10/2012 Gurcan et al.
8,841,893 B2 9/2014 Bulzacchelli et al.
9,170,590 B2 10/2015 Price et al.
9,223,329 B2 12/2015 Pulvirenti et al.
9,274,534 B2 3/2016 Fang et al.
9,292,026 B2 3/2016 Bhattad
9,377,798 B2 6/2016 Bhai
9,543,826 B2 1/2017 Chen et al.
9,577,508 B2 2/2017 Wang
9,588,541 B1 3/2017 Ho et al.
9,608,522 B2 3/2017 Lin et al.
9,684,325 B1 6/2017 Rasmus
9,740,225 B1 8/2017 Wong
9,746,864 B1 8/2017 Narang et al.
9,778,672 B1 10/2017 Gao et al.
9,946,283 B1 4/2018 Yung et al.
9,983,604 B2 5/2018 Lee et al.
10,013,005 B1 7/2018 Ippili
10,133,289 B1 11/2018 Ankamreddi et al.
10,234,883 B1 3/2019 Du et al.
10,310,530 B1 6/2019 Lu et al.
10,411,599 B1 9/2019 Shi et al.
10,444,780 B1 10/2019 Cheng et al.
10,459,468 B1 10/2019 Ankamreddi et al.
10,545,523 B1 1/2020 Wu et al.
10,591,938 B1 3/2020 Golara
2003/0178976 A1 * 9/2003 Xi ..... G05F 1/575 323/273
2004/0000896 A1 * 1/2004 Barber, Jr. ..... G05F 1/575 323/280
2004/0027097 A1 2/2004 Denicholas et al.
2004/0140845 A1 7/2004 Eberlein
2005/0189930 A1 9/2005 Wu et al.
2005/0206444 A1 9/2005 Perez et al.
2005/0248331 A1 11/2005 Whittaker et al.
2006/0164053 A1 7/2006 Walter et al.
2006/0181258 A1 8/2006 Benbrik
2007/0057655 A1 3/2007 Nishida
2007/0139030 A1 6/2007 Lee et al.
2007/0242536 A1 10/2007 Matsubara
2008/0211467 A1 9/2008 Huang et al.
2008/0278127 A1 11/2008 Nagata
2008/0303496 A1 12/2008 Schlueter et al.
2009/0010035 A1 1/2009 Williams
2009/0179622 A1 7/2009 Ivanov et al.
2009/0189591 A1 7/2009 Sperling et al.
2009/0219077 A1 9/2009 Pietri et al.
2009/0243568 A1 10/2009 Nguyen
2009/0322429 A1 12/2009 Ivanov et al.
2010/0327959 A1 12/2010 Lee
2011/0089916 A1 4/2011 Soenen et al.
2011/0156674 A1 * 6/2011 Lin ..... G05F 1/575 323/282
2012/0112718 A1 5/2012 Pons
2012/0187897 A1 7/2012 Lenk et al.
2012/0229111 A1 9/2012 Serdarevic
2012/0299564 A1 11/2012 Howes et al.
2013/0082671 A1 4/2013 Ivanov et al.
2013/0099764 A1 4/2013 Zhang et al.
2013/0113447 A1 5/2013 Kadanka
2013/0181521 A1 7/2013 Khlat
2013/0221940 A1 8/2013 Yan et al.
2014/0042998 A1 2/2014 Saito et al.
2014/0084896 A1 3/2014 Zhang et al.
2014/0139197 A1 5/2014 Price et al.
2014/0139198 A1 5/2014 Manlove et al.
2014/0253072 A1 * 9/2014 Hussien ..... H02M 1/36 323/288
2014/0266103 A1 9/2014 Wang et al.
2014/0277812 A1 9/2014 Shih et al.
2014/0306676 A1 10/2014 Hu et al.
2014/0340058 A1 * 11/2014 Wang ..... H02M 1/15 323/268
2015/0028828 A1 1/2015 Chen
2015/0103566 A1 4/2015 Keogh et al.
2015/0115809 A1 4/2015 Siessegger
2015/0115830 A1 4/2015 Siessegger
2015/0130434 A1 5/2015 Jain et al.
2015/0137780 A1 5/2015 Lerner et al.
2015/0160668 A1 6/2015 Pujol et al.
2015/0168969 A1 6/2015 Shor
2015/0188421 A1 7/2015 Ko
2015/0192943 A1 7/2015 Roham et al.
2015/0198959 A1 7/2015 Kuttner
2015/0198960 A1 7/2015 Zhang et al.
2015/0220096 A1 * 8/2015 Luff ..... G02F 1/1368 327/109
2015/0349622 A1 12/2015 Lo et al.
2015/0362936 A1 12/2015 Patel et al.
2016/0124448 A1 5/2016 Murukumpet et al.
2016/0349776 A1 12/2016 Conte et al.
2017/0017250 A1 * 1/2017 Peluso ..... G05F 1/575
2017/0045901 A1 2/2017 Price et al.
2017/0052552 A1 2/2017 Mahmoudi et al.
2017/0083034 A1 * 3/2017 Yang ..... G05F 1/575
2017/0115680 A1 * 4/2017 Zhou ..... G05F 1/575
2017/0117803 A1 4/2017 Matsuki et al.
2017/0185096 A1 * 6/2017 Rueger ..... G05F 3/262
2017/0205841 A1 7/2017 Jefremow et al.
2017/0212540 A1 7/2017 Cho et al.
2017/0220059 A1 8/2017 Kadowaki
2017/0269620 A1 * 9/2017 Duong ..... G05F 1/63
2017/0322575 A1 11/2017 Du et al.
2017/0364110 A1 12/2017 Golara et al.
2017/0371365 A1 * 12/2017 Kossel ..... G05F 1/46
2018/0217623 A1 8/2018 Bhattad et al.
2019/0146532 A1 5/2019 Ballarin et al.
2020/0201374 A1 6/2020 Golara
2020/0244160 A1 7/2020 Mitev
2021/0223810 A1 7/2021 Golara

FOREIGN PATENT DOCUMENTS

CN 101419477 A 4/2009
CN 102043417 A 5/2011
CN 202494944 U 10/2012
CN 103034275 A 4/2013
CN 203745939 U 7/2014
CN 104345763 A 2/2015
CN 105917285 A 8/2016
CN 106959721 A 7/2017
CN 108445950 A 8/2018
DE 102012100146 A1 7/2012
EP 1253498 A1 10/2002

(56) References Cited

FOREIGN PATENT DOCUMENTS

| | | | |
|---|---|---|---|
| EP | 1508078 | B1 | 12/2010 |
| EP | 2849020 | A1 | 3/2015 |
| TW | 200933333 | A | 8/2009 |
| TW | 201013355 | A | 4/2010 |
| TW | I357204 | B | 1/2012 |
| TW | I397793 | B | 6/2013 |
| WO | 2012004083 | A1 | 1/2012 |
| WO | 2012047738 | A1 | 4/2012 |
| WO | 2014042726 | A1 | 3/2014 |
| WO | 2014177901 | A1 | 11/2014 |
| WO | 2015047276 | A1 | 4/2015 |
| WO | 2016026416 | A1 | 2/2016 |
| WO | 2016082420 | A1 | 6/2016 |
| WO | 2016202398 | A1 | 12/2016 |
| WO | 2017075156 | A1 | 5/2017 |

OTHER PUBLICATIONS

Guo J., et al., "A 6-μW Chip-Area-Efficient Output-Capacitorless LDO in 90-nm CMOS Technology", IEEE Journal of Solid-State Circuits, IEEE Service Center, Piscataway, NJ, USA, vol. 45, No. 9, Sep. 1, 2010 (Sep. 1, 2010), pp. 1896-1905, XP011317129, ISSN: 0018-9200, DOI: 10.1109/JSSC.2010.2053859, abstract; figure 6.

Hinojo J.M., et al., "FVF-Based Low-Dropout Voltage Regulator with Fast Charging/Discharging Paths for Fast Line and Load Regulation", ETRI Journal, vol. 39, No. 3, Jun. 1, 2017 (Jun. 1, 2017), pp. 373-382, XP055646709, KR ISSN 1225-6463, DOI: 10.4218/etrij.17.0116.0766, abstract; figure 3.

Paxton A., "Extend Battery Life with a LDO, a Voltage Supervisor and a FET", Jul. 31, 2017 (Jul. 31, 2017), XP055671473, 5 pages, Retrieved from the Internet: URL: https://web.archive.org/web/20170731140511/http://e2e.ti.com:80/blogs_/archives/b/fullycharged/archive/2017/02/21/extend-battery-life-with-a-ldo-a-voltage-supervisor-and-a-fet [retrieved on Feb. 25, 2020] p. 2-p. 5.

Akhamal H., et al., "Fast Transient Response Low Drop-out Voltage Regulator," International Journal of Embedded Systems and Applications (IJESA), Sep. 2014, vol. 4, No. 2/3, pp. 1-10.

Alon E., et al., "Replica Compensated Linear Regulators for Supply-Regulated Phase-Locked Loops," IEEE Journal of Solid-State Circuits, vol. 41, No. 2, Feb. 2006, pp. 413-424.

Assi A., et al., "A Fully Differential and Tunable CMOS Current Mode opamp Based on Transimpedance-Transconductance Technique", Circuits and Systems, 1997. Proceedings of the 40th Midwest Symposium on Sacramento, CA, USA Aug. 3-6, 1997, New York, NY, USA, IEEE, US, vol. 1, Aug. 3, 1997 (Aug. 3, 1997), pp. 168-171, XP010272437, DOI: 10.1109/MWSCAS.1997.666060, ISBN: 978-0-7803-3694-0.

Bontempo G., et al., "Low Supply Voltage, Low Quiescent Current, ULDO Linear Regulator," The 8th IEEE International Conference on Electronics, Circuits and Systems 2001, pp. 409-412.

Bulzacchelli J.F., et al., "Dual-Loop System of Distributed Microregulators With High DC Accuracy, Load Response Time Below 500 ps, and 85-mV Dropout Voltage," IEEE Journal of Solid-State Circuits, vol. 47, No. 4, Apr. 2012, pp. 863-874.

Camacho D., et al., "An NMOS Low Dropout Voltage Regulator with Switched Floating Capacitor Gate Overdrive," Department of Electrical Engineering, Southern Methodist University, Dallas, Texas, USA, 52nd IEEE International Midwest Symposium on Circuits and Systems, Aug. 2009, pp. 808-811.

Den Besten G.W., et al., "Embedded 5 V-to-3.3 V Voltage Regulator for Supplying Digital IC's in 3.3 V CMOS Technology," IEEE Journal of Solid-State Circuits, vol. 33, No. 7, Jul. 1998, pp. 956-962.

Gupta V., et al., "A Low Dropout, CMOS Regulator with High PSR over Wideband Frequencies", IEEE International Symposium on Circuits and Systems, May 2005, pp. 4245-4248.

Hazucha P., et al., "Area-Efficient Linear Regulator With Ultra-Fast Load Regulation", IEEE Journal of Solid-State Circuits, vol. 40, No. 4, Apr. 2005, pp. 933-940.

Huang H-Y., et al., "A Wideband CMOS Transconductance-Transimpedance Amplifier", Midwest Symposium on Circuits and Systems. Cairo, Egypt, Dec. 27-30, 2003; [Midwest Symposium on Circuits and Systems], Piscataway, NJ, IEEE, US, vol. 1, Dec. 27, 2003 (Dec. 27, 2003), pp. 153-156, XP010867413, DOI: 10.1109/MWSCAS.2003.1562241, ISBN: 978-0-7803-8294-7.

Lu Y., et al., "A 0.65ns-Response-Time 3.01ps FOM Fully-Integrated Low-Dropout Regulator with Full-Spectrum Power-Supply—Rejection for Wideband Communication Systems," IEEE International Solid-State Circuits Conference, Technical Papers, Feb. 2014, pp. 306-307. Retrieved from the Internet: URL:http://www.researchgate.net/publication/271550565.

Milliken R.J., et al., "Full on-chip CMOS low-dropout voltage regulator", IEEE Transactions on Circuits and Systems 1: Regular Papers, vol. 54, No. 9, Sep. 2007, pp. 1879-1890.

Rincon-Mora G.A., et al., "A Low-Voltage, Low Quiescent Current, Low Drop-Out Regulator," IEEE Journal of Solid-State Circuits, Jan. 1998, vol. 33, No. 1, pp. 36-44.

Teel J.C., "Understanding power supply ripple rejection in linear regulators", Analog Applications Journal, Analog and Mixed-Signal Products, 2005, 4 Pages.

Favrat P., et al., "A New High Efficiency CMOS Voltage Doubler", Proceedings of The IEEE 1997 Custom Integrated Circuits Symposium, Santa Clara, May 5-8, 1997, [Proceedings of The IEEE Custom Integrated Circuits Symposium], New York, IEEE, US, vol. Conf, 19, May 5, 1997 (May 5, 1997), XP000751486, pp. 259-262, ISBN: 978-0-7803-3670-4 abstract, figure 7.

Maksimovic D., et al., "Switched—Capacitor DC-DC Converters for Low-Power on-Chip Applications", Power Electronics Specialists Conference, 1999, PESC 99, 30TH Annual IEEE Charleston, SC, USA Jun. 27-Jul. 1, 1999, Piscataway, NJ, USA, IEEE, US, vol. 1, Jun. 27, 1999 (Jun. 27, 1999), XP010346884, pp. 54-59, DOI: 10.1109/PESC. 1999.788980 ISBN: 978-0-7803-5421-0 abstract, figure 8.

* cited by examiner

SIMULTANEOUS LOW QUIESCENT CURRENT AND HIGH PERFORMANCE LDO USING SINGLE INPUT STAGE AND MULTIPLE OUTPUT STAGES

FIELD OF DISCLOSURE

Aspects of the present disclosure relate generally to low dropout (LDO) voltage regulators, and more particularly to a simultaneous low quiescent current and high performance LDO voltage regulator having a single input stage and multiple output stages.

BACKGROUND

Although battery operated devices are convenient and have a wide range of applications, these devices must accommodate a wide voltage range supplied from battery (e.g., 2.4V-4.8V). Therefore, systems on chip (SoC's) designed for battery operated devices typically include voltage regulators to regulate the supply voltage received from the battery to provide a voltage within a narrower range (e.g., 2.9V-3.3V). A common type of regulator used is low dropout (LDO) voltage regulators.

To conserve power, many battery operated devices support multiple power modes. For example, common power modes include an active mode for high performance (a.k.a. high performance mode), to playback high quality audio, and a low power mode, such as deep sleep/dormant mode, for power saving to extend battery life. Therefore, there is a need in the art to provide voltage regulators having good performance in high performance mode while consuming very low current in low power mode. Furthermore, it is desired to provide voltage regulators that are quiet during power mode transitions. In other words, voltage regulators having large undershoot or overshoot are not desired.

SUMMARY OF THE DISCLOSURE

The following presents a simplified summary of one or more embodiments in order to provide a basic understanding of such implementations. This summary is not an extensive overview of all contemplated implementations, and is intended to neither identify key or critical elements of all embodiments nor delineate the scope of any or all embodiments. Its sole purpose is to present some concepts of one or more implementations in a simplified form as a prelude to the more detailed description that is presented later.

In some implementations, a low dropout (LDO) voltage regulator includes a first and a second pass transistors, and an error amplifying module. A source of the first pass transistor is coupled to a source of the second pass transistor and the sources of the first and second pass transistors are configured to receive an input voltage (Vin). The error amplifying module includes a first output, a second output, a first input, and a second input, the first output coupled to a gate of the first pass transistor, and the second output coupled to a gate of the second pass transistor. The error amplifying module further includes a first output stage coupled to the first output, the first output stage configured to drive the gate of the first pass transistor during a high performance (HP) mode, and a second output stage coupled to the second output, the second output stage configured to drive the gate of the second pass transistor during the HP mode and during a low power (LP) mode.

In some implementations, the LDO voltage regulator further includes an output node to provide an output voltage, a first resistor coupled between the output node and a feedback node, and a second resistor coupled between a ground and the feedback node.

In some implementations, the error amplifying module further includes an input stage having a first input, a second input, and an output, wherein the first input is configured to receive a reference voltage, the second input is coupled to the feedback node to receive a feedback voltage (Vfb), the first output is coupled to the first output stage of the error amplifying module, and the output is coupled to the first and the second output stages of the error amplifying module.

In some implementations, the second output stage of the error amplifying module further includes a p-type field effect transistor (pFET) having a source, a drain, and a gate, wherein the source is configured to receive the Vin, the gate and the drain are coupled to the gate of the second pass transistor; and an n-type field effect transistor (nFET) having a source, a drain, and a gate, wherein the source is coupled to the ground, the drain is coupled to the drain of the pFET, and the gate is coupled to the output of the input stage.

In some implementations, the first output stage of the error amplifying module further includes a first pFET having a source, a gate, and a drain, wherein the source is configured to receive the Vin; a second pFET having a source, a gate, and a drain, wherein the source is configured to receive the Vin, the gate and the drain are coupled to the gate of the first pFET; a first nFET having a source, a gate, and a drain, wherein the source is coupled to the ground, the drain is coupled to the drain of the first pFET, and the gate is coupled to the output of the input stage; and a second nFET having a source, a gate, and a drain, wherein the source is coupled to the ground, the drain is coupled to the drain of the second pFET, and the gate is coupled to the drain of the first nFET.

In some implementations, the first output stage of the error amplifying module further includes a first switch coupled between the source of the first nFET and the ground, a second switch coupled between the gate of the second nFET and the Vin, and a third switch coupled between the gate of the second pFET and the Vin.

In some implementations, the LDO voltage regulator further includes a fourth switch coupled between the gate of the first pass transistor and the Vin. During operation, the first switch is configured to be off and the second, third, and fourth switches are configured to be turned on in the LP mode. Further, the first switch is configured to be on and the second, third, and fourth switches are configured to be turned off in the HP mode.

In some implementations, the first pass transistor is larger than the second pass transistor.

In some implementations, the LDO voltage regulator can be incorporated into a system on a chip (SoC). The SoC can further include a core circuit, wherein the core circuit is coupled to the output node of the LDO voltage regulator, and the core circuit is configured to be powered by the output voltage from the LDO voltage regulator. Moreover, the Vin can be provided by a battery.

To the accomplishment of the foregoing and related ends, the one or more implementations include the features hereinafter fully described and particularly pointed out in the claims. The following description and the annexed drawings set forth in detail certain illustrative aspects of the one or more implementations. These aspects are indicative, however, of but a few of the various ways in which the principles of various implementations may be employed and the description embodiments are intended to include all such aspects and their equivalents.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details. In some instances, well-known structures and components are shown in block diagram form in order to avoid obscuring such concepts.

A conventional approach to support both high performance mode and low power mode in battery operated devices is to use two separate low dropout (LDO) voltage regulators connected in parallel. One example of this dual LDO approach is illustrated in FIG. 1.

Figure 1:
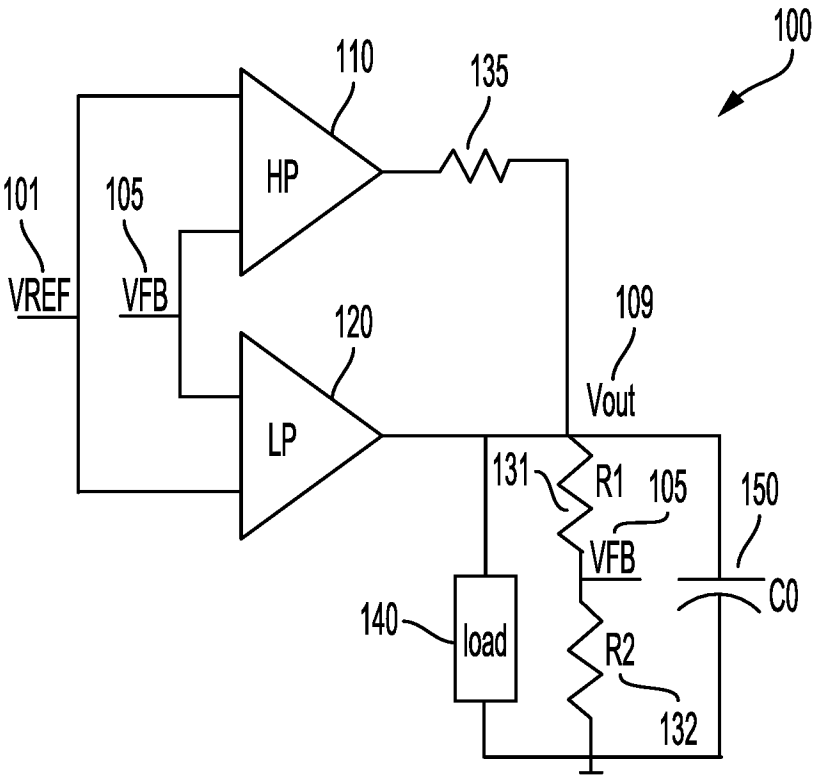
FIG. 1 PRIOR ART
FIG. 1 shows a conventional configuration of two low dropout (LDO) voltage regulators to support multiple power modes.

FIG. 1 shows a conventional configuration 100 of two low dropout (LDO) voltage regulators to support two power modes in a system on a chip (SoC) applicable in a battery-powered device. Configuration 100 includes a first LDO voltage regulator 110 to support high performance (HP) mode, a second LDO voltage regulator 120 to support low power (LP) mode, three resistors 131, 132, and 135, a load 140, and an output capacitor C0 150. Both LDO voltage regulators 110 and 120 receive the same input signals, namely, a reference voltage VREF 101 and a feedback voltage VFB 105. The output of LDO voltage regulator 110 is coupled to resistor 135, while the output of LDO voltage regulator 120 is coupled to a node between resistor 135 and resistor R1 131. Resistor R1 131 is further coupled in series to resistor R2 132, which is coupled to ground. The feedback voltage VFB 105 is generated at the node between resistor R1 131 and resistor R2 132. Both load 140 and output capacitor C0 150 are coupled in parallel to resistors R1 131 and resistors R2 132. In other words, both load 140 and output capacitor C0 150 are coupled between the output of the second LDO voltage regulator 120 and ground. An output voltage is provided at an output node Vout 109 where the output of the second LDO voltage regulator 120, the load 140, and the output capacitor C0 150 are all coupled to. The output node is also the node between resistor 135 and resistor R1 131.

In general, the HP mode and the LP mode are two different power modes in which the SoC incorporating the LDO voltage regulators 110 and 120 can operate in. As used herein, a high performance (HP) mode refers to an active mode for high performance in a SoC. The SoC may enter the HP mode to playback high quality audio, to activate signal transceivers (e.g., short range wireless transceiver), and to perform complex and/or power consuming tasks, such as noise cancelling, machine learning programs, etc. On the other hand, a low power (LP) mode refers to a deep sleep or dormant power mode for power saving to extend battery life. The SoC may enter the LP mode after an extended period of inactivity, or in response to a user request, etc. One of skilled in the art would appreciate that various SoC's may support more than one LP mode and/or more than one HP mode.

Due to the difference in offset and gain of the two LDOs 110 and 120, one of the LDOs 110 and 120 always takes precedence even though both LDOs 110 and 120 are on. This causes both LDOs 110 and 120 to be turned off briefly during mode transitions (e.g., from HP mode to LP mode, or vice versa), resulting in a drop in the output voltage when the load 140 is connected to the output node 109. In some conventional design, the output droop can be avoided by using linear LDO voltage regulator for HP mode and hysteretic LDO voltage regulator for LP mode. But this comes at the expense of large ripple at the output in LP mode. Moreover, the use of two separate LDO voltage regulators requires more silicon area.

To address the above issues of the conventional configuration 100 shown in FIG. 1, a novel LDO voltage regulator is proposed, which uses a single input stage and multiple output stages in an error amplifying module of such LDO regulator.

Figure 2:
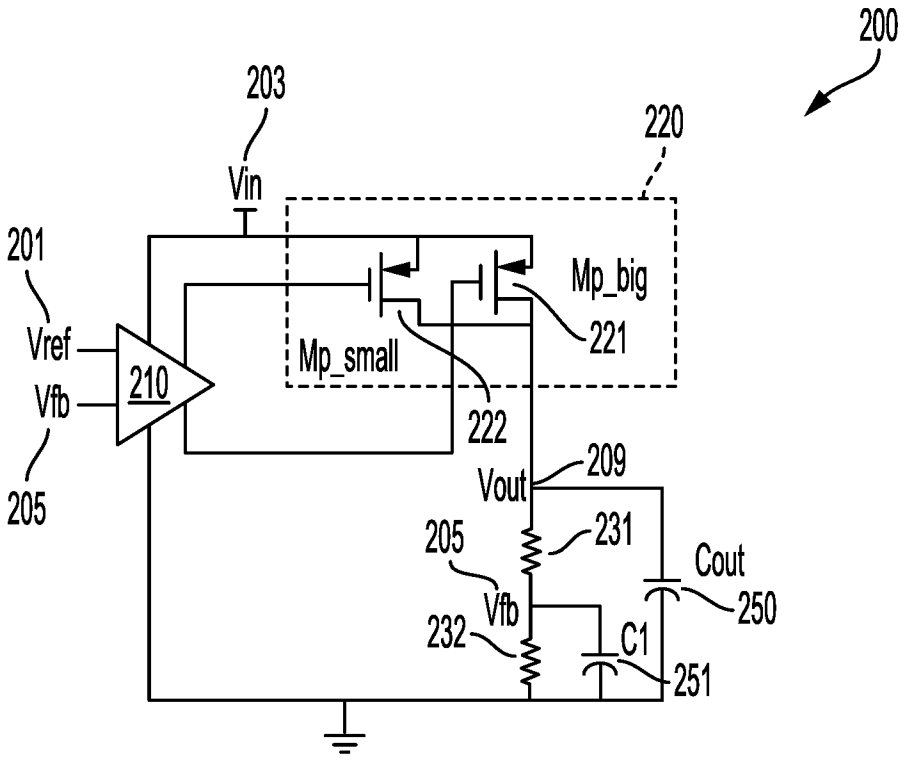
FIG. 2 shows one implementation of a LDO voltage regulator to support both a low power mode and a high performance mode.

FIG. 2 shows one implementation of a LDO voltage regulator 200 to support both a low power (LP) mode and a high performance (HP) mode. The LDO voltage regulator 200 includes an error amplifying module 210, a pass stage 220 having a first pass transistor (Mp_big) 221 and a second pass transistor (Mp_small) 222, a first resistor 231 coupled to an output node 209, a second resistor 232 coupled between the first resistor 231 and ground, a capacitor C1 251 coupled in parallel with the second resistor 232, and an output capacitor Cout 250 coupled between the output node 209 and ground. The LDO voltage regulator 200 provides an output voltage Vout at the output node 209.

The pass transistors 221 and 222 can be implemented with p-type field effect transistors (pFETs). Further, the first pass transistor 221 can be bigger than the second pass transistor 222. For example, the width of the gate (or channel) of the first pass transistor 221 can be longer than the width of the gate (or channel) of the second pass transistor 222. As the first pass transistor 221 is bigger than the second pass transistor 222 physically, the first pass transistor 221 is capable of accommodating a larger current flowing through than the second pass transistor 222.

In some implementations, the error amplifying module 210 includes a single input stage to receive a reference voltage Vref 201 and a feedback voltage Vfb 205, which is from the feedback node between the first and the second resistors 231 and 232. The input stage can include a differential pair of transistors to receive Vref 201 and Vfb 205. The error amplifying module 210 further includes a first and a second output stages to drive the two pass transistors 221 and 222, respectively. Specifically, the first output stage can be turned on or activated to drive the first pass transistor 221 during the HP mode. In the LP mode, the first output stage can be turned off or deactivated. On the other hand, the second output stage can be turned on or activated to drive the second pass transistor 222 during the HP mode and during the LP mode. In both HP and LP modes, the input stage stays on (or remains activated). In some implementations, the second output stage is smaller than the first output stage. Further, the second output stage can be kept on whenever the LDO voltage regulator 200 is on, thus, the second output stage may also be referred to be "always-on." On the other hand, the first output stage is larger than the second output stage and the first output stage is a high current stage that responds very fast (or at least faster than the second output stage). As mentioned above, the first output stage is turned on in HP mode, but not in LP mode. Like the second output stage, the input stage remains on (or activated) in both LP and HP modes.

One advantage provided by the combination of the single input stage operating with the first and the second output stages is to facilitate a smooth transition between the HP mode and the LP mode. Further, there is no ripple in Vout because the LDO voltage regulator 200 is linear. Moreover, by using two output stages (namely, the first and the second output stages) in the error amplifying module 210, the SoC incorporating the LDO voltage regulator 200 can avoid having two (2) LDO voltage regulators (such as the configuration 100 shown in FIG. 1), thus, saving silicon area. More details of one implementation of the error amplifying module 210 including the first and second output stages are described below and shown in FIG. 3.

Figure 3:
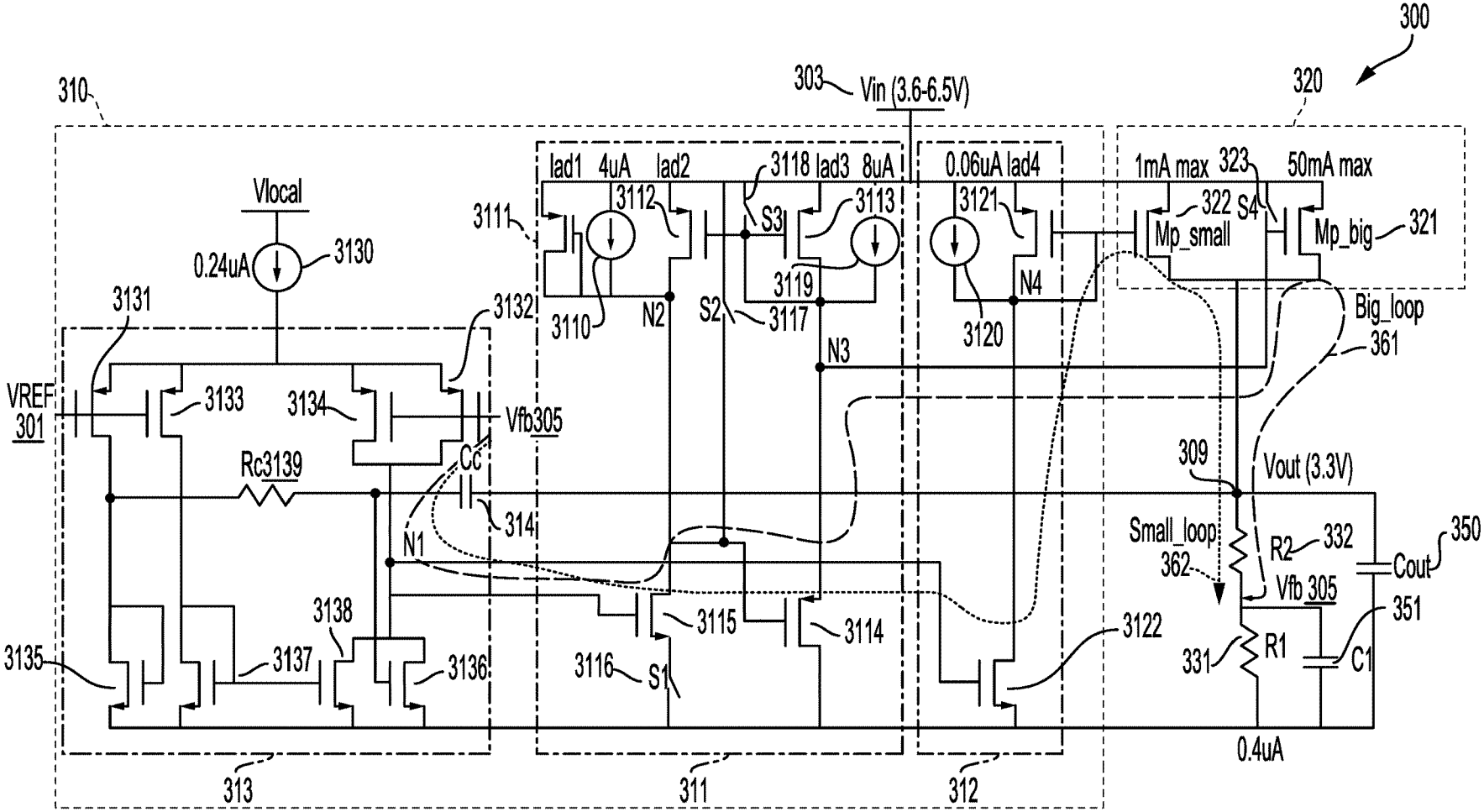
FIG. 3 shows one implementation of a LDO voltage regulator to support a low power mode and a high performance mode.

FIG. 3 shows one implementation of a LDO voltage regulator 300 to support a low power mode and a high performance mode. The LDO voltage regulator 300 includes an error amplifying module 310, a pass stage 320 having a first pass transistor (Mp_big) 321 and a second pass transistor (Mp_small) 322, a first feedback resistor 331 coupled to an output node 309, a second feedback resistor R2 332 coupled between the first feedback resistor R1 331 and ground, a capacitor C1 351 coupled in parallel with the second feedback resistor 332, and an output capacitor Cout 350 coupled between the output node 309 and ground. The LDO voltage regulator 300 provides a regulated output voltage Vout at the output node 309. In some implementations, Vout is at about 3.3V and the current flowing through R1 331 and R2 332 is about 0.4 μA.

The pass transistors 321 and 322 can be implemented with p-type field effect transistors (pFETs). Further, the first pass transistor 321 can be bigger than the second pass transistor 322. For example, the width of the gate (or channel) of the first pass transistor 321 can be longer than the width of the gate (or channel) of the second pass transistor 322. As the first pass transistor 321 is bigger than the second pass transistor 322 physically, the first pass transistor 321 is capable of accommodating a larger current flowing through than the second pass transistor 322. In some implementations, the maximum current allowed through the first pass transistor 321 (Mp_big) is about 50 mA, while the maximum current allowed through the second pass transistor 322 (Mp_small) is about 1 mA.

In some implementations, the error amplifying module 310 includes a single input stage 313 to receive a reference voltage Vref 301 and a feedback voltage Vfb 305, which is from the feedback node between the first and the second feedback resistors 331 and 332. The input stage 313 includes four (4) pFET's 3131, 3132, 3133, and 3134, and four (4) n-type field effect transistors (nFET's) 3135, 3136, 3137, and 3138. The gates of pFET's 3131 and 3133 are coupled together and configured to receive a reference voltage Vref 301. Likewise, the gates of pFET's 3132 and 3134 are coupled together and configured to receive a feedback voltage Vfb 305. The feedback voltage Vfb 305 is taken from the node between the first feedback resistor 331 and the second feedback resistor 332. The sources of pFET's 3131, 3132, 3133, and 3134 are all coupled to a local current source 3130. In some implementations, the local current source 3130 provides a current of about 0.24 μA. On one side of the input stage 313, the drains of pFET's 3131 and 3133 are coupled to the drains of nFET's 3135 and 3137, respectively. The drains of nFET's 3135 and 3137 are also coupled to the gates of the respective nFET. On the other side, the drains of pFET's 3133 and 3134 are both coupled to the drains of nFET's 3136 and 3138 at node N1. The gate of nFET 3136 is coupled to the node between resistor Rc 3138 and capacitor Cc 314. The gate of nFET 3138 is coupled to the gate of nFET 3137. The sources of nFET's 3135, 3136, 3137, and 3138 are all coupled to ground. Resistor Rc 3138 is coupled between the gate of nFET 3136 and the drain of nFET 3135. Capacitor 314 is coupled between resistor Rc 3138 and the output node 309. In operation, the input stage stays on (or remains activated) in both HP and LP modes.

The error amplifying module 310 further includes a first output stage 311 and a second output stage 312 to drive the two pass transistors 321 and 322, respectively. The second output stage 312 includes a pFET 3121, an nFET 3122, and a current source 3120. In some implementations, the current source 3120 can provide a current of about 0.06 μA. The pFET 3121 is coupled in parallel to the current source 3120. The source of pFET 3121 is configured to receive an input voltage Vin 303. In some implementations, Vin 303 can range from 3.6V to 6.5V, and Vin 303 may be supplied by a removable power source, such as a battery. The drain and the gate of pFET 3121 are coupled together at node N4, and further coupled to the gate of the second pass transistor (Mp_small) 322. The drain of pFET 3121 is coupled to the drain of nFET 3122. The source of nFET 3122 is coupled to the ground. The gate of nFET 3122 is coupled to node N1 of the input stage 313. During operation, the second output stage 312, driven by the voltage at node N1 of the input stage 313, drives the second pass transistor (Mp_small) 322. The second output stage 312 can be turned on or activated to drive the second pass transistor (Mp_small) 322 during the HP mode and during the LP mode.

The first output stage 311 includes four (4) pFET's 3111, 3112, 3113, and 3114, an nFET 3115, a switch S1 3116, a switch S2 3117, a switch S3 3118, a first current source 3110, and a second current source 3119. In some implementations, the first current source 3110 can provide a current of about 4 μA, and the second current source 3119 can provide a current of about 8 μA. The sources of pFET's 3111, 3112, and 3113 are coupled together and configured to receive Vin 303. The gate of pFET 3111 is coupled to its drain and the drain of pFET 3112 at node N2. The gates of pFET's 3112 and 3113 are coupled together to the drain of pFET 3113 at node N3. The source of pFET 3114 is also coupled to node N3, while the gate of pFET 3114 is coupled to node N2. In addition, the gate of pFET 3114 is coupled via switch S2 3117 to Vin 303. The drain of pFET 3114 is coupled to ground. The drain of nFET 3115 is coupled to node N2, while its gate is coupled to node N1. The source of nFET 3115 is coupled via switch S1 3116 to ground.

To support HP mode, both the first output stage 311 and the second output stage 312 are activated (or turned on) to drive both pass transistors 321 and 322. To support LP mode, the second output stage 312 is activated (or turned on) to drive pass transistor 322, while the first output stage 311 is deactivated (or turned off). In some implementations, the switches S1 3116, S2 3117, S3 3118, and S4 323 can be operated as discussed below to turn on/off the first and second output stages 311 and 312 as the LDO voltage regulator 300 transitions in/out of HP and LP modes. When the LDO voltage regulator 300 transitions into LP mode, S1

3116 is turned off and S2 3117, S3 3118, and S4 323 are turned on. By turning S1 3116 off and turning S2 3117 and S3 3118 on, the first output stage 311 is turned off. By turning S4 323 on, a high voltage, Vin 303, is applied to the gate of pass transistor 321 (Mp_big), which is a pFET in the implementation shown in FIG. 3, to turn pass transistor 321 (Mp_big) off. As such, pass transistor 322 (Mp_small), and the second output stage 312 remains on during LP mode. A small loop 362 (a.k.a. the LP loop) is formed by pass transistor 322 (Mp_small) (which has a gate coupled to node N4, a source coupled to Vin 303, and a drain coupled to Vout 309), second feedback resistor R2 332 (which is coupled between output node 309 and Vfb 305, to drive the input transistors 3132 and 3134 of the input stage 313), node N1, the input transistors 3132 and 3134 of the input stage 313 receiving Vfb 305 and the nFET 3122 (coupled between nodes N1 and N4 within the second output stage 312). The size of the pass transistor 322 (Mp_small) in the LP loop can be very small due to a smaller maximum load current requirement in the LP mode and as a result, no voltage follower is required in the LP loop.

When the LDO voltage regulator 300 transitions from LP mode to HP mode, S1 3116 is turned on and S2 3117, S3 3118, and S4 323 are turned off. By turning on S1 3116 and turning off both S2 3117 and S3 3118, the first output stage 311 is turned on. By turning off S4 323, the first pass transistor 321 (Mp_big) is turned on. A big loop 361 (a.k.a. the HP loop) is now formed with the first pass transistor 321 (Mp_big), the second feedback resistor R2 332, the input transistors 3132 and 3134 of the input stage 313 receiving Vfb 305, node N1, nFET 3115 and pFET 3114 in the first output stage 311, and node N3. This big loop 361 can provide additional current to the output node 309. Note that the small loop 362 remains active in HP mode. When the load current is small (e.g., 0-10 uA), the small loop 362 regulates the output voltage Vout at the output node 309 because N4 node voltage is smaller than N3 node voltage and the voltage across the source and the gate of the first pass transistor Mp_big 321 is not big enough to turn on the first pass transistor Mp_big 321 at this load. This provides at least two benefits as compared to conventional scheme. First, in a conventional scheme, a load tracking zero which degrades transients (overshoot/undershoot) and consumes extra layout area is added at node N1 to improve no load stability (phase margin). In the LDO voltage regulator 300, no load tracking zero is required because the small loop 362 handles the small current. Second, in conventional LDO voltage regulators, smaller feedback resistors (R1 and R2) are used to keep the minimum current above a predetermined threshold (e.g., current threshold >10 uA) and to ensure good phase margin at no load. In the LDO voltage regulator 300, larger feedback resistors R1 331 (e.g., about 3 Mohm) and R2 332 (e.g., about 5.25 Mohm) can be used and as a result, and thus the quiescent current of LDO voltage regulator 300 (i.e., the current consumed by the LDO voltage regulator 300 at no load) can be reduced compared to conventional LDO voltage regulators.

Another advantage of the LDO voltage regulator 300 is the elimination of ripple in Vout at the output node 309 as the LDO voltage regulator 300 is linear. Furthermore, the differential pair (i.e., pFET's 3131, 3132, 3133, and 3134) in the input stage 313 is kept on in both LP and HP modes. This facilitates the smooth transition between HP and LP modes as the first output stage 313 is a high current stage and responds very fast. Using only an additional small output stage (i.e., the second output stage 312), the LDO voltage regulator 300 can replace two separate LDOs in some conventional configuration (e.g., the configuration 100 shown in FIG. 1), thus saving significant silicon area. The LDO voltage regulator 300 is particularly advantageous in applications requiring compact LDO voltage regulators with low quiescent current and high performance. One exemplary application of such a LDO voltage regulator is discussed in details below.

Figure 4:
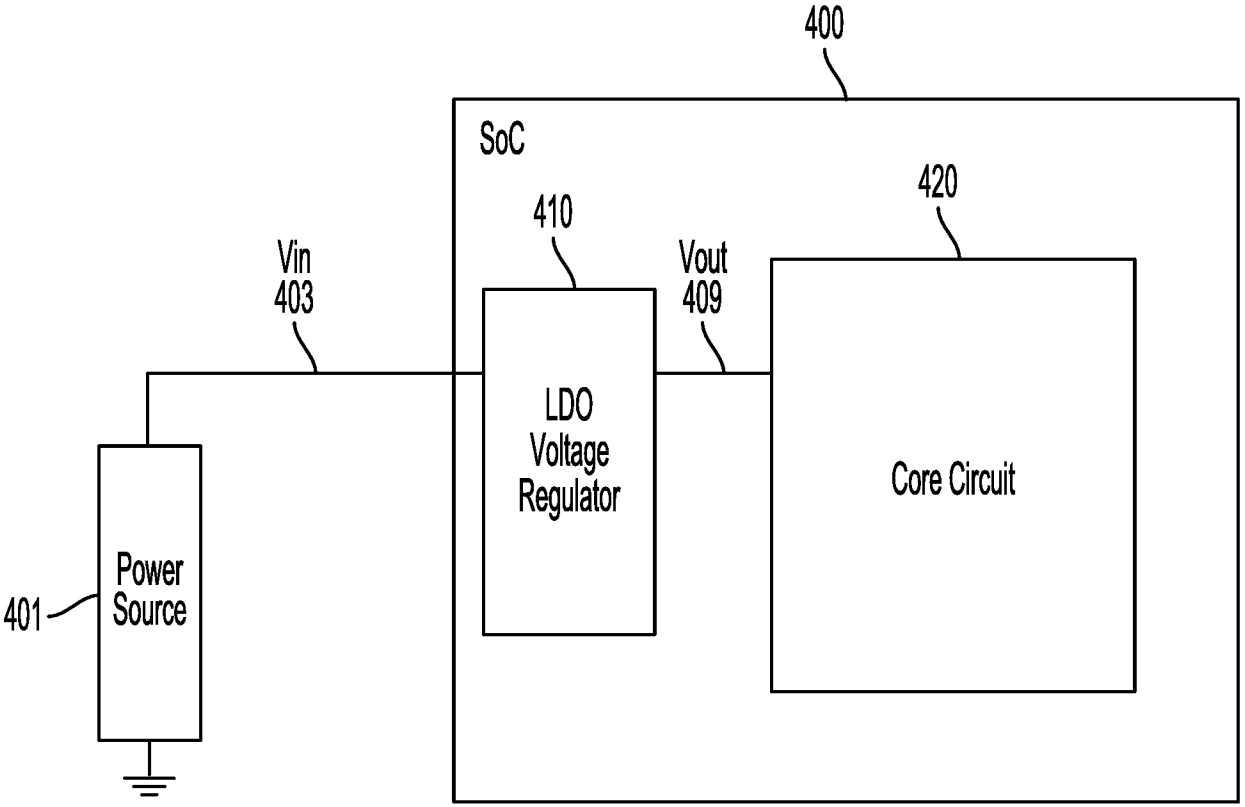
FIG. 4 shows one implementation of a system on a chip (SoC).

FIG. 4 shows one implementation of a system on a chip (SoC) 400. The SoC 400 can be an audio SoC incorporated into audio devices, such as earbuds. The SoC 400 includes a LDO voltage regulator 410 and a core circuit 420. The core circuit 420 may include one or more of an audio processor, an amplifier, high performance analog to digital converters (ADCs) and digital to analog converters (DACs), biasing circuits (e.g., biasing circuit for microphone), etc. One of skilled in the art would readily appreciate that the SoC 400 can include additional components not shown in FIG. 4, such as an audio signal interface, an antenna, etc. The SoC 400 can be electrically coupled to a portable and/or removable power source 401, such as a battery or a power bank. The battery 401 can provide power in the form of a voltage Vin 403 (such as Vin 303 in FIG. 3) to the SoC 400. However, because the voltage Vin 403 from the battery 401 can potentially vary across a range wider than the range acceptable to the core circuit 420, Vin 403 is input to LDO voltage regulator 410. The LDO voltage regulator 410 regulates the voltage Vin 403 to generate a more stable and lower output voltage Vout 409 to power the core circuit 420. Moreover, the SoC 400 can operate in multiple power modes, such as high performance (HP) mode and low power (LP) mode discussed above. Thus, the LDO voltage regulator 410 also supports HP mode and LP mode. Some implementations of the LDO voltage regulator 410 have been discussed above with reference to FIGS. 2 and 3.

Figure 5:
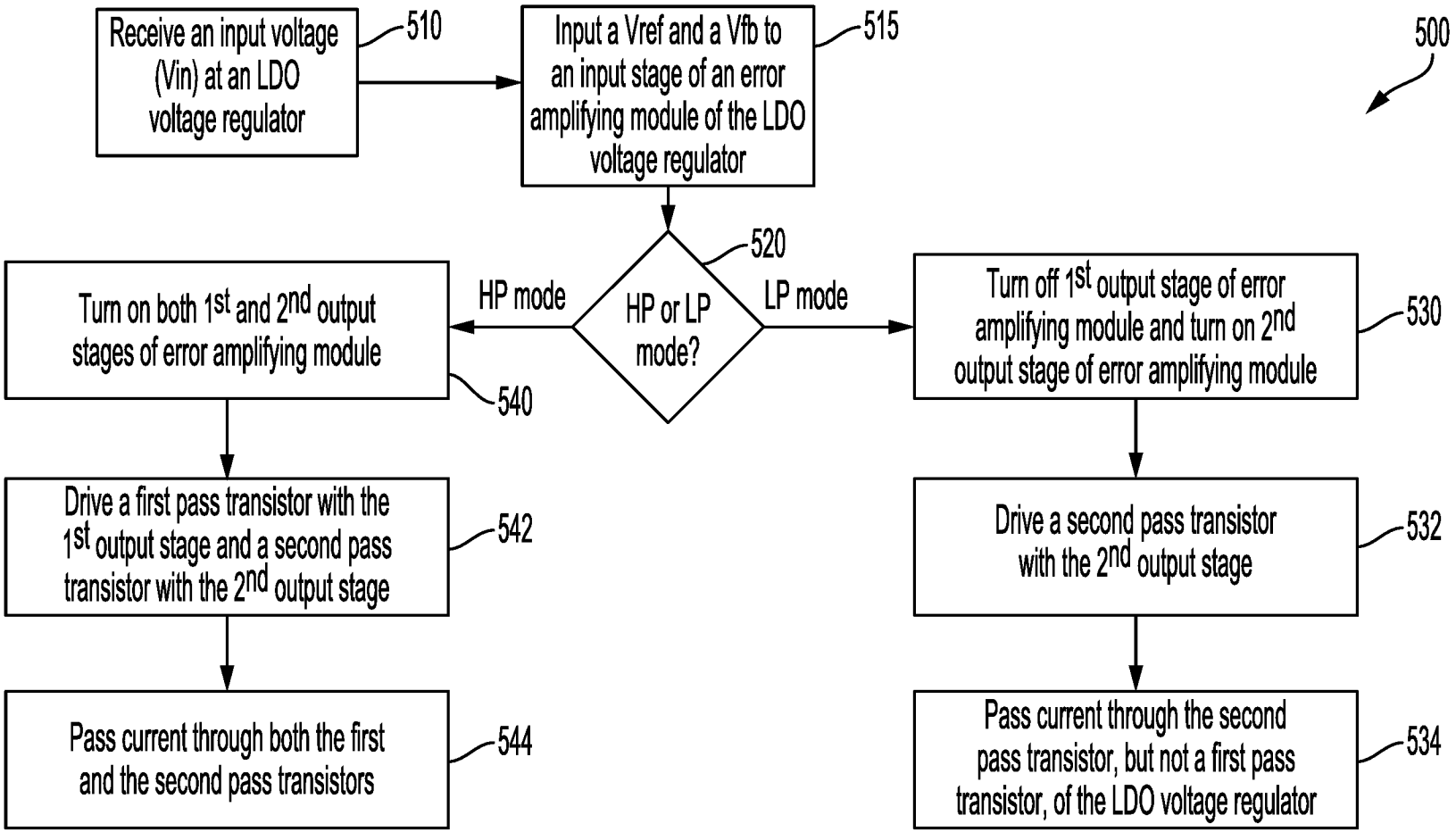
FIG. 5 shows one implementation of a method to provide a regulated output voltage using a low dropout (LDO) voltage regulator.

FIG. 5 shows one implementation of a method 500 to provide a regulated output voltage using a low dropout (LDO) voltage regulator, such as the LDO voltage regulators shown in FIGS. 2 and 3. In some implementations, the LDO voltage regulator includes an error amplifying module having a first and a second pass transistors, a single input stage, and a first and a second output stages. The first pass transistor can be bigger than the second pass transistor. Further, the first output stage can be associated with the HP mode, while the second output stage can be associated with both the HP mode and the LP mode. The LDO voltage regulator may be implemented within an SoC (such as SoC 400 in FIG. 4).

In some implementations, the method 500 begins at block 510, where the LDO voltage regulator receives an input voltage. The input voltage can be provided by a portable and/or removable power source, such as a battery or a power bank. The method 500 then transitions to block 515, where a reference voltage (Vref) and a feedback voltage (Vfb) associated with a regulated output voltage to the input stage of the error amplifying module. The method 500 then transitions from block 515 to block 520 to determine if the SoC is operating in a HP mode or a LP mode. If the SoC is operating in the HP mode, then the method 500 transitions to block 540. Otherwise, if the SoC is operating in the LP mode, then the method 500 transitions to block 530.

In block 530, where the SoC is operating in LP mode, the first output stage of the error amplifying module is turned off, and the second output stage of the error amplifying module is turned on. Then the method 500 transitions to block 532, where the second output stage drives the second pass transistor. Then the method 500 transitions to block 534, where current is passed through the second pass transistor but not the first pass transistor, to provide a regulated output voltage usable by core circuits of the SoC.

As discussed above, if the SoC is operating in the HP mode, then the method 500 transitions from block 520 to block 540, where the first and the second output stages of the error amplifying module are both turned on. Then the method 500 transitions to block 542, where the second output stage drives the second pass transistor and the first output stage drives the first pass transistor. Then the method 500 transitions to block 544, where current is passed through both the first and the second pass transistors to provide a regulated output voltage usable by core circuits of the SoC.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples described herein but is to be accorded the widest scope consistent with the principles and novel features disclosed herein.

What is claimed is:

1. A low dropout (LDO) voltage regulator, comprising:

a first pass transistor;

a second pass transistor, wherein a source of the first pass transistor is coupled to a source of the second pass transistor and the sources of the first and second pass transistors are configured to receive an input voltage (Vin);

an output node to provide an output voltage;

a first resistor coupled between the output node and a feedback node;

a second resistor coupled between a ground and the feedback node;

an error amplifying module having a first output, a second output, a first input, and a second input, the first output coupled to a gate of the first pass transistor, and the second output coupled to a gate of the second pass transistor, wherein the error amplifying module further includes a first output stage coupled to the first output, the first output stage configured to drive the gate of the first pass transistor during a high performance (HP) mode, a second output stage coupled to the second output, the second output stage configured to drive the gate of the second pass transistor during the HP mode and during a low power (LP) mode, and an input stage having a first input, a second input, and an output, wherein the first input is configured to receive a reference voltage, the second input is coupled to the feedback node to receive a feedback voltage (Vfb), the first output is coupled to the first output stage of the error amplifying module, and the output is coupled to the first and the second output stages of the error amplifying module, wherein the second output stage of the error amplifying module comprises:

a p-type field effect transistor (pFET) having a source, a drain, and a gate, wherein the source is configured to receive the Vin, the gate and the drain are coupled to the gate of the second pass transistor; and an n-type field effect transistor (nFET) having a source, a drain, and a gate, wherein the source is coupled to the ground, the drain is coupled to the drain of the pFET, and the gate is coupled to the output of the input stage;

wherein the first output stage of the error amplifying module comprises:

a first pFET having a source, a gate, and a drain, wherein the source is configured to receive the Vin;

a second pFET having a source, a gate, and a drain, wherein the source is configured to receive the Vin, the gate and the drain are coupled to the gate of the first pFET;

a first nFET having a source, a gate, and a drain, wherein the source is coupled to the ground, the drain is coupled to the drain of the first pFET, and the gate is coupled to the output of the input stage; and a third pFET having a source, a gate, and a drain, wherein the drain is coupled to the ground, the source is coupled to the drain of the second pFET, and the gate is coupled to the drain of the first nFET;

a first switch coupled between the source of the first nFET and the ground;

a second switch coupled between the gate of the third pFET and the Vin; and a third switch coupled between the gate of the second pFET and the Vin; and a fourth switch coupled between a gate of the first pass transistor and the Vin, wherein the first switch is configured to be off and the second, third, and fourth switches are configured to be turned on in the LP mode.

2. The LDO voltage regulator of claim 1, wherein the first switch is configured to be on and the second, third, and fourth switches are configured to be turned off in the HP mode.

3. The LDO voltage regulator of claim 1, wherein the first pass transistor is larger than the second pass transistor.

4. A system on chip (SoC), comprising the LDO voltage regulator of claim 1, and a core circuit, wherein the core circuit is coupled to the output node of the LDO voltage regulator, and the core circuit is configured to be powered by the output voltage from the LDO voltage regulator.

5. The SoC of claim 4, wherein the Vin is provided by a battery.

* * * * *